US006564949B1

(12) United States Patent
Saathoff

(10) Patent No.: US 6,564,949 B1
(45) Date of Patent: May 20, 2003

(54) HOLDER FOR A POWER-OPERATED SCREWDRIVER AND THE LIKE

(76) Inventor: Konstanze Saathoff, Wiesenstrasse 12, Hasbergen (DE), D 49205

( * ) Notice: Subject to any disclaimer, the term of this patent is extended or adjusted under 35 U.S.C. 154(b) by 0 days.

(21) Appl. No.: 09/423,043

(22) PCT Filed: May 5, 1998

(86) PCT No.: PCT/DE98/01233

§ 371 (c)(1),
(2), (4) Date: Oct. 29, 1999

(87) PCT Pub. No.: WO98/50204

PCT Pub. Date: Nov. 12, 1998

(30) Foreign Application Priority Data

May 5, 1997 (DE) ..... 197 18 833

(51) Int. Cl.[7] ..... A47F 7/00
(52) U.S. Cl. ..... 211/70.6; 211/94.01
(58) Field of Search ..... 211/70.6, 70.5, 211/94.01, 60.1

(56) References Cited

U.S. PATENT DOCUMENTS

| | | | | | |
|---|---|---|---|---|---|
| 1,780,872 | A | * | 11/1930 | Dumben | 211/70.5 |
| 2,371,433 | A | * | 3/1945 | Davis | 211/70.6 |
| 3,603,550 | A | * | 9/1971 | Byrd | 211/71 |
| 3,836,058 | A | * | 9/1974 | Penniman et al. | 224/41.1 F |
| 3,845,546 | A | * | 11/1974 | Rutschke | 29/568 |
| 3,893,606 | A | * | 7/1975 | Hofmann | 224/42.1 F |
| 3,897,895 | A | * | 8/1975 | Read | 224/42.1 B |
| 3,905,214 | A | * | 9/1975 | Bell | 70/58 |
| 4,209,098 | A | * | 6/1980 | Adams | 211/60 R |
| 4,705,177 | A | * | 11/1987 | Oren | 211/70.5 |
| 4,763,797 | A | * | 8/1988 | Egan | 211/70.5 |
| 5,102,177 | A | * | 4/1992 | Dreisig et al. | 294/106 |
| 5,277,689 | A | * | 1/1994 | Ruetschle et al. | 483/36 |
| 5,908,374 | A | * | 6/1999 | Kato | 483/42 |

FOREIGN PATENT DOCUMENTS

| | | |
|---|---|---|
| CH | 537 257 | 7/1973 |
| DE | PS 949 640 | 9/1956 |
| DE | 27 03 357 | 8/1978 |
| DE | 86 20 138 | 9/1986 |
| DE | 36 01 230 | 8/1987 |
| DE | 34 41 653 | 12/1987 |
| EP | 0 158 061 | 10/1985 |
| GB | 1 480 476 | 7/1977 |

OTHER PUBLICATIONS

Item—Der Gesamtkatalog—MB System, pp. 21, 22, 40 and 41, Nov. 1989.

* cited by examiner

*Primary Examiner*—Daniel P. Stodola
*Assistant Examiner*—Khoa Tran
(74) *Attorney, Agent, or Firm*—Merchant & Gould P.C.

(57) ABSTRACT

A holder (1) for hand-held power-operated, specially rod or pistol shaped devices such as pneumatic screwdrivers and the like, comprising two retaining jaws (3) which are arranged on a common support rail (2) and can be fixed at a variable distance from each other. A bearing surface oriented towards the support rail (2) is allocated to the retaining jaws (3). The retaining jaws (3) can be rotated around an axis running at an approximate right angle throughout the bearing surface and can be fixed in at least two angle positions. The retaining jaws (3) have a first recess (7) which can be directed towards the device to receive and hold the device. The retaining jaws (3) can be fixed at a varying orientation to the support. The retaining jaws (3) and the bearing surface form a common component. The retaining jaws (3) have a second recess (7, 9, 10). The recesses are arranged around the axis in the peripheral surfaces of the retaining jaws (3). An additional recess (11) accommodating the actuating lever (8) of the device to be held is provided in at least one recess (10).

14 Claims, 6 Drawing Sheets

HOLDER FOR A POWER-OPERATED SCREWDRIVER AND THE LIKE

CROSS-REFERENCES TO RELATED APPLICATIONS

Not Applicable

STATEMENT REGARDING FEDERALLY FUNDED RESEARCH

Not Applicable

REFERENCE TO A "MICROFICHE APPENDIX"

Not Applicable

BACKGROUND OF THE INVENTION

1. Field of the Invention

The invention concerns a holding device adapted for holding implements.

2. Description of the Related Art

In industry frequent use is made of hand operated apparatus, as for example pneumatically or electrically driven screwdrivers. Such screwdrivers are known in various arrangements. They can have a form similar to a boring machine or a pistol, with an actuating lever that is activated by the index finger. Another design form is approximately rod-shaped and displays at its head an angular gear of 90°, so that the tool itself is arranged at angle of 90° with respect to the screwdriver.

As holding devices for these screwdrivers and the like, quivers are known that, for example, are manufactured from rubber. The quivers are formed in an approximately funnel-shaped manner, and thus are downwardly tapered and display over their height vertical strips molded on in a laterally outward manner, into which strips screws and nut can be vulcanized, in order to enable the attachment of the quiver to a load bearing structure on the assembly line or the like present in the factory.

These quivers are suitable for many devices only in a limited manner. If the pistol-type device is hung in these quivers, the device frequently rests with its actuating lever upon the edge of the quiver. Through the device's own weight the actuating lever is pushed in sufficient far that the device begins to run. Because of this, not only is the noise level inside the factory increased, but also the device wears out prematurely, an unnecessary energy consumption results, and, in the case of devices powered by compressed air, the required compressor power becomes unnecessarily high, since devices are running in idle while not being used.

For the taking up of rod-shaped devices, these quivers are likewise suitable only in a very limited way. According to their structural height, they cannot take up these devices completely, because of the relatively long length of the rod-shaped devices, so that the latter can easily fall out of the quiver. If the lower end of the quiver is open, then it offers the rod-shaped devices no support, but rather these fall downward out of the quiver.

In practice, therefore, a remedy is often provided by constructing special holders for the devices used in each case. This usually takes place in the factory's own workshop. This self-production has the disadvantage that often materials that are readily at hand are used, frequently, for example, expensive objects that are actually intended for other purposes. In addition, each of the holder structures produced in this manner represents a unique structure that is comparatively time-consuming and therefore of considerable expense.

When the making of one's own holding device does not take place, the screwdrivers, for lack of a suitable place to put them, are frequently placed on a shelf or some other more or less horizontal surface located nearby. In this case, there exists the danger that the devices will fall down if they are not laid down carefully enough or if, through tensioning of or pressure upon the electrical or pneumatic supply line, the device is moved. The repair costs for such devices are considerable and, in the case of the rod-shaped devices in particular, the angular gearing located at the head is susceptible to damage that requires expensive repairs.

DE 86 20 138 U1 shows a holding device in accordance with the general class, with retaining jaws that can be attached to the base part in different angular positions; the retaining jaws, together with the base parts, are mounted on a common support rail in a displaceable manner. The base parts here lie with bearing surfaces on the support rail. The retaining jaws and base part form a two-part holder, in which the base parts also display recesses. Only the retaining jaws with their recess can be adjusted to different angular positions, while the base parts with their recesses always remain in the same alignment. A special securing or fixing of the retaining jaws is not provided for here. An unnoticed loosening of the retaining jaws is thus not excluded. This can take place, for example, when the device is inadvertently placed into the holder, or removed from this, at a tilt, and can lead to the falling out of the device to be held, thus to its being damaged. A secure holding of the implement is thus not ensured.

U.S. Pat. No. 2,371,433 and DE 34 41 653 C2 show one-piece holding parts that display recesses for devices. The reception recess for holding the device is thus not created through the interplay of two retaining jaws, since no provision is made for retaining jaws that are adjustable to each other in the sense of the present invention.

CH 537 257 shows two retaining jaws that are slidable on a common support rail; however, these jaws are not mounted so as to be rotatable around an axis, but rather are attached to the support rail in merely a longitudinally adjustable manner.

DE 27 03 367 A1 shows rollers arranged on a common support rail in a longitudinally traveling manner, which rollers are mounted so as to rotate around an axis. These rollers do not display recesses, in particular not first and second recesses, since the rollers have the same contour over their entire length. In addition, the holders are uneconomically expensive, i.e. are built from several parts; the bearing surface on the support rail is formed by a first component and the roller by several additional components.

DE PS 949 640 shows clamp devices that are mounted on common support rails so as to be longitudinally adjustable. Here, however, it is not the case that two clamp devices arranged on the same vertical strut work in conjunction with each other, but rather that in each case one clamp device on the first vertical strut works together with a clamp device arranged at the same height on the other vertical strut, and between the two clamp devices a storage tray is provided for as the actual holder for the tools.

From the publication "Item—Der Gesamtkatalog—MB System", pages 21, 22, 40, and 41, have been known, at the latest since November 1989, support rails to which, for example, retaining jaws for tools can be attached in a longitudinally adjustable manner. The design of the retaining jaws, however, cannot be learned from this publication.

The mentioned screwdrivers are mechanically complex and accordingly both expensive and delicate, so that shocks and blows, such as occur during the improper putting away of these tools, are especially disadvantageous. The problem described in relation to the screwdrivers is also relevant in principle to other rod or pistol shaped tools.

BRIEF SUMMARY OF THE INVENTION

The invention is based on the task of improving a holding device of the generic type in such a manner that it makes possible an optimal holding of the greatest possible number of different implements and holds these in a secure manner.

This task underlying the invention is accomplished through several steps, namely:

a) the retaining jaws and the bearing surface form in common one component:

Achieved by this means is a greater stability compared to the device of the same generic type described in DE 86 20 138 U1, in which the retaining jaws are inserted into a base piece and this in turn is attached to the support rail.

b) the retaining jaws display in each case not only one, but at least a second recess:

While a second recess in the base piece at a fixed, predetermined alignment is provided for in the holding device of the generic type, the several recesses in the holding jaw in the holding device according to the invention make possible, through the rotatable mounting of the holding jaw, the use by choice of one of these several recesses, so that an optimal adaptation to the implement to be held in each case is possible.

c) the recesses are arranged around the axis on the peripheral surfaces of the retaining jaws:

Through rotation of the retaining jaws, in the above-mentioned manner the desired recesses are selectable by choice, in order to form the desired holding recess for holding the implement.

d) in at least one recess, provision is made for an additional recess for accommodating the actuating lever of the implement to be held:

Through this additional recess it is ensured that the implement does not continue to run in idle in the holding device and wear out prematurely. Rather, the actuating lever can be held without pressure in the additional recess.

Advantageously, provision can be made for the recesses in the block-shaped base body of a holding jaw to graduate with chamfers or roundings into the outer contour of the holding jaw. In this way, for one thing, relatively pointed corners and edges are avoided, on which the implement could possibly be damaged when being placed into the holding device. Secondly, a funnel-shaped guide for the implement is created, so that the implement can be taken out in an especially quick and convenient manner, without possibly hanging up on sharp-angled edges.

A stepless adjustability makes possible any alignment of the retaining jaws whatever, so that ergonomically advantageous sequences of work events can be aided, e.g. in the fact that oblique insertions of the implements into the holding device are made easier and the holding device is individually adapted to the body size and the movement sequence of each user.

A secure guiding of the tool into the holding device can be made possible by having the retaining jaws form a holding recess with a relatively long length in the form of a holding quiver that rest against the implement. The tilt incline of an implement situated in such a holding quiver is considerably reduced by this guiding.

Advantageously, such a holding quiver can run conically, in order to support the secure holding of the tool.

A material-sparing holding of the tool in the holding device, in particular when the tool, in rough everyday use, is more thrown into the device than carefully placed into it, can be ensured by the fact that the retaining jaws are cushioned at the appropriate spots in order to protect the tool. For example, this can take place through glued-on, pillow-like shock absorbing bodies or through padding set into the surfaces of the retaining jaws, as this is known, for example, from the production of tool grips, where alternating regions of hard and soft materials can be designed.

Advantageously, the retaining jaws can, on the one hand, have a solid core that ensures the fundamental stability of the retaining jaws and thus make possible a secure hold of the implement place into it, in which case, on the other hand, provision is made for a blow-absorbing shell in the form of an absorbing body. To this end, the core can consist, for example, of metal or a solid plastic that is subsequently surrounded by foam, so that the absorbing body determines the outer contour of the holding jaw. The danger of the falling off of absorbing bodies that are only regionally applied from outside, e.g. glued on, is thereby avoided.

In order to make possible a play-free application of the retaining jaws to the support, provision can be made for the absorbing body to surround the core almost completely, but on the application surface for the core to attach directly to the support. In addition, a complete protective effect can result from the fact that all of the areas that do not adjoin the support are cushioned.

The "secure" holding of the implement in the holding device can also be developed with respect to possible theft in an especially sure manner if, for example, provision is made for a lockable security apparatus, by means of which the implement can be fixed in the holding device.

Further advantageous developments of the invention can be learned about from the dependent claims.

BRIEF DESCRIPTION OF THE SEVERAL VIEWS OF THE DRAWINGS

Implementation examples of the invention will be explained in more detail in the following in connection with the drawings. They show.

DETAILED DESCRIPTION OF THE INVENTION

Figure 1:
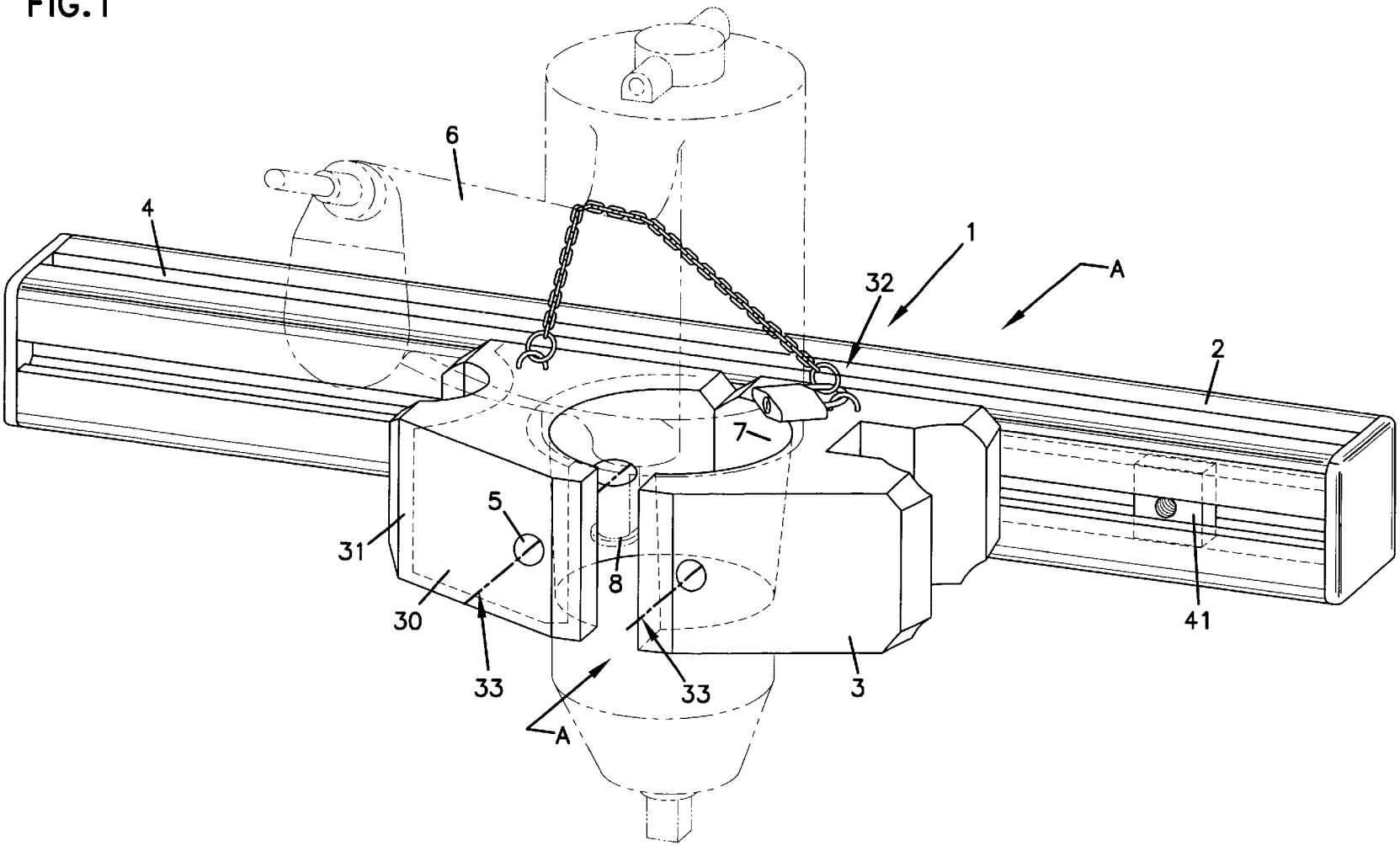
FIG. 1 is an implementation example of a holding device with differently arranged retaining jaws.

Indicated in general in FIG. 1 with numeral 1 is a holding device that consists of a support rail 2 and two retaining jaws 3. The support rail is formed with a rectangular metal-bar extrusion profile and displays on all four sides in each case a longitudinally running groove 4. The retaining jaws 3 are detachably fastened with screws to sliding blocks 41, which are arranged in one such groove 4. The screws are accessible from the exterior through bores 5, in order to make possible a detaching and adjusting of the retaining jaws 3 on the support rail 2.

The retaining jaws 3 display a number of recesses. The retaining jaws are adapted to rotate about axes 33 generally perpendicular to the support beam. By rotation of the retaining jaws, any of the recesses in one jaw may be oriented so as to cooperate with any of the recesses of the other jaw, so that the recesses may cooperate to form a variety of quivers adapted to support a variety of implements. Represented in FIG. 1 is the arrangement of the retaining jaws 3 for holding a pistol-type pneumatic screwdriver, which is indicated schematically with numeral 6. In the represented arrangement, two large main recesses 7 of the two retaining jaws 3 are arranged so as to face each other, so that as a whole a holding quiver for the screwdriver 6 results. For a secure fixing this quiver is tapered downward through an appropriately oblique wall design of the main recesses 7. The front side of the retaining jaws 3, turned away from the support rail 2, is formed in such a way that they do not come together to form a closed circle, but rather leave a free space on the front side turned away from the support rail 2, into which an actuating lever 8 of the pneumatic screwdriver 6 can dip, so that the screwdriver 6 can be placed into the holding device 1 without continuing to run in idle due to an actuating lever in the activation position.

The holding device can be easily adapted to larger tools than that represented in FIG. 1 by loosening, through the bores 5, the screws with which the retaining jaws 3 are attached to the support rail 2. Subsequently, the retaining jaws together with their screws and the sliding blocks 41 can be pushed into the groove 4 in the support rail 2 and adjusted to the desired distance. In the desired position the retaining jaws 3 can be fixed by the screws, so that after this one-time adjustment the holding device 1 can remain in the once-set position maintenance-free up to the time when a different tool is used.

With the aid of the three other grooves into which the retaining jaws 3 are not fastened, the support rail 2 can be attached to a support, for example fastened onto or underneath or onto the side of a platform or framework, a shelf, or the like. By means of this detachable attachment of the collective holding device 1 to a support, it is possible in a simple manner to reposition the holding device 1, for example when in an automobile factory the assembly line is rearranged for a different type of vehicle and consequently the tools used must be available at another location. In contrast to welded-on holding hooks or holding eyes, which are fixedly welded to the existing equipment, the holding device 1 makes possible an easy change of location, so that, on the one hand, at the newly required location no additional holding device need be created, and at the old location a holding device remaining there does not hinder the work flow.

Figure 2:
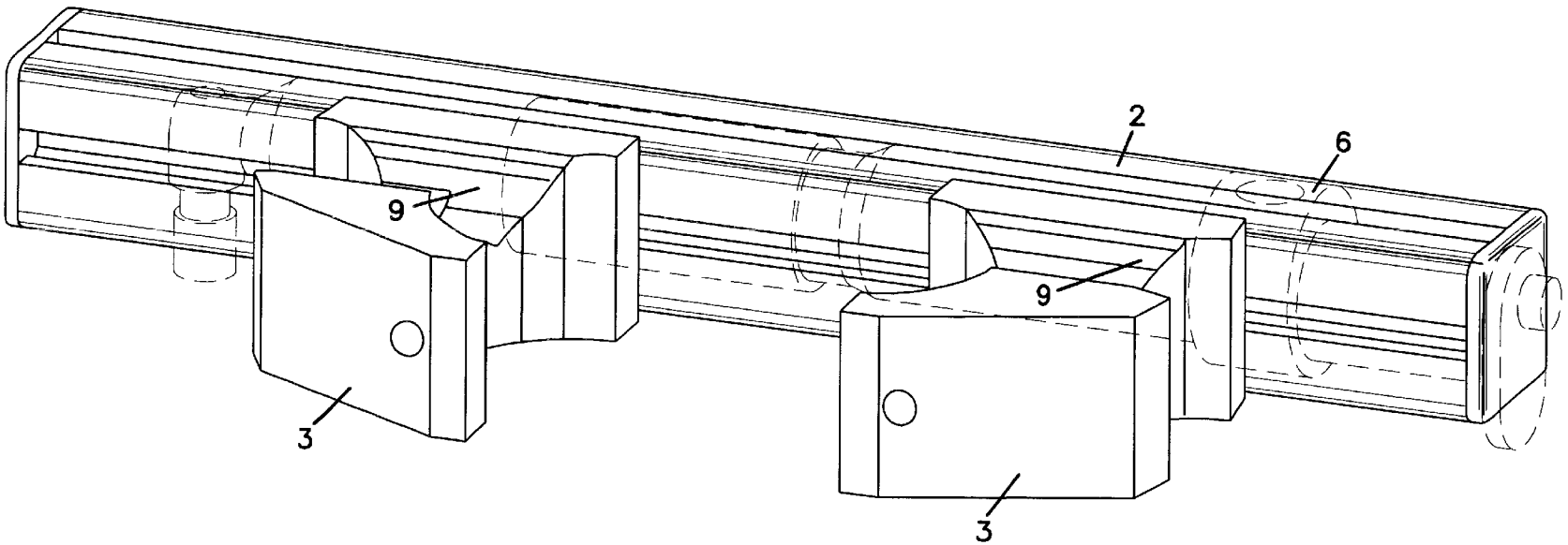
FIG. 2 is the holding device of FIG. 1, with the retaining jaws rotated to another position.

In the arrangement according to FIG. 2, the retaining jaws 3 are attached to the carrier rail 2 in a more drawn-apart position. In addition, the entire carrier rail 2 is swung 180°, so that the hitherto top side of the retaining jaws 3 is directed downward. Accordingly, the side of the retaining jaws 3 arranged at the bottom in FIG. 1 is visible in FIG. 2 as the top side. It displays two recesses 9, similar to the main recesses 7, contoured as segments of a circle, which recesses, however, have a smaller radius than the main recesses 7. In the arrangement represented, the two recesses 9 are aligned with each other and make possible—as is likewise visible from FIG. 2—the horizontal placing down of a pneumatic screwdriver 6; in FIG. 2 this screwdriver is represented as a rod-shaped model.

Figure 3:
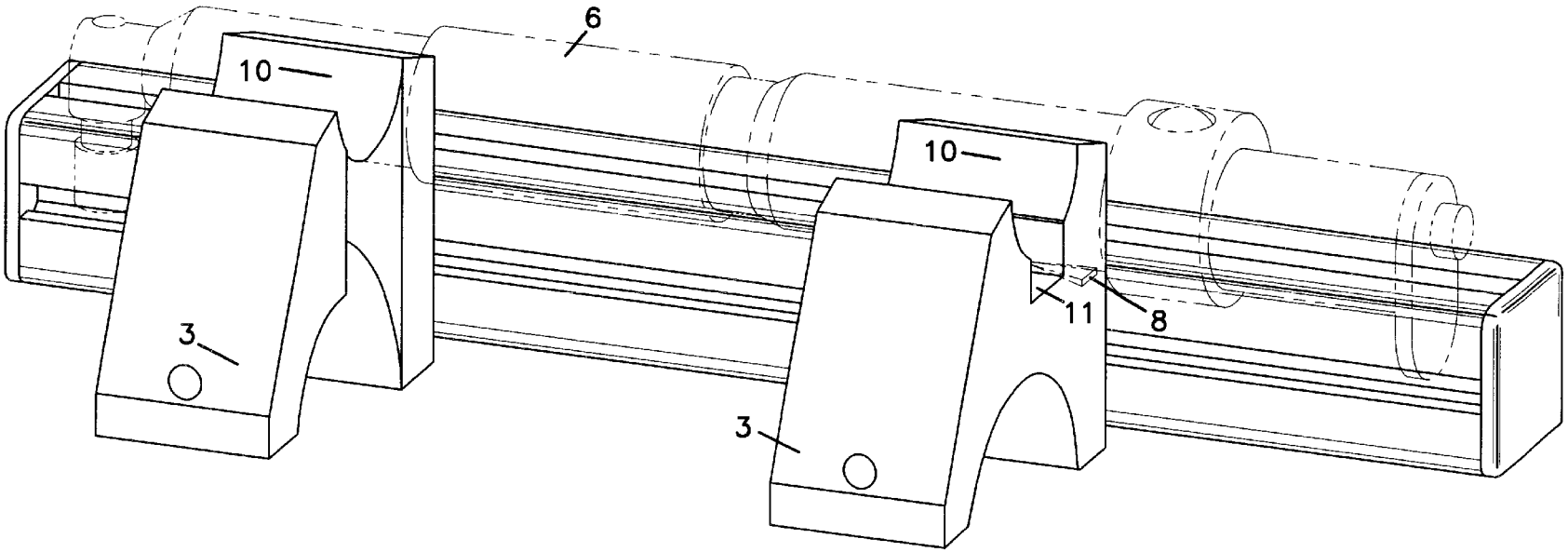
FIG. 3 is the holding device of FIGS. 1 and 2, with the retaining jaws rotated to another position.

In FIG. 3, the two retaining jaws 3 are arranged drawn apart still further compared with FIGS. 1 and 2, and with respect to their position represented in FIG. 1 are rotated 90° around their fastening screw for attachment to the carrier rail 2. The now above-lying sides of the retaining jaws 3 display two recesses 10 that are aligned with each other, one of the two recesses 10 displaying an additional recess 11 that receives the actuating lever 8 of a schematically indicated pneumatic screwdriver 6; in FIG. 3 a screwdriver 6 of the same type as in FIG. 2 is represented.

The arrangement of the two retaining jaws corresponding to FIG. 3 makes possible the fixing of the screwdriver 6 at two points that are as far apart as possible, so that an especially stable and secure placing of the screwdriver 6 is ensured. Since with the model of the screwdriver 6 represented the actuating lever lies precisely in the region of one holding jaw 3, the additional recess 11 prevents an operation in idle of the screw driver 6 after it has been placed in the holding device 1.

Figure 4:
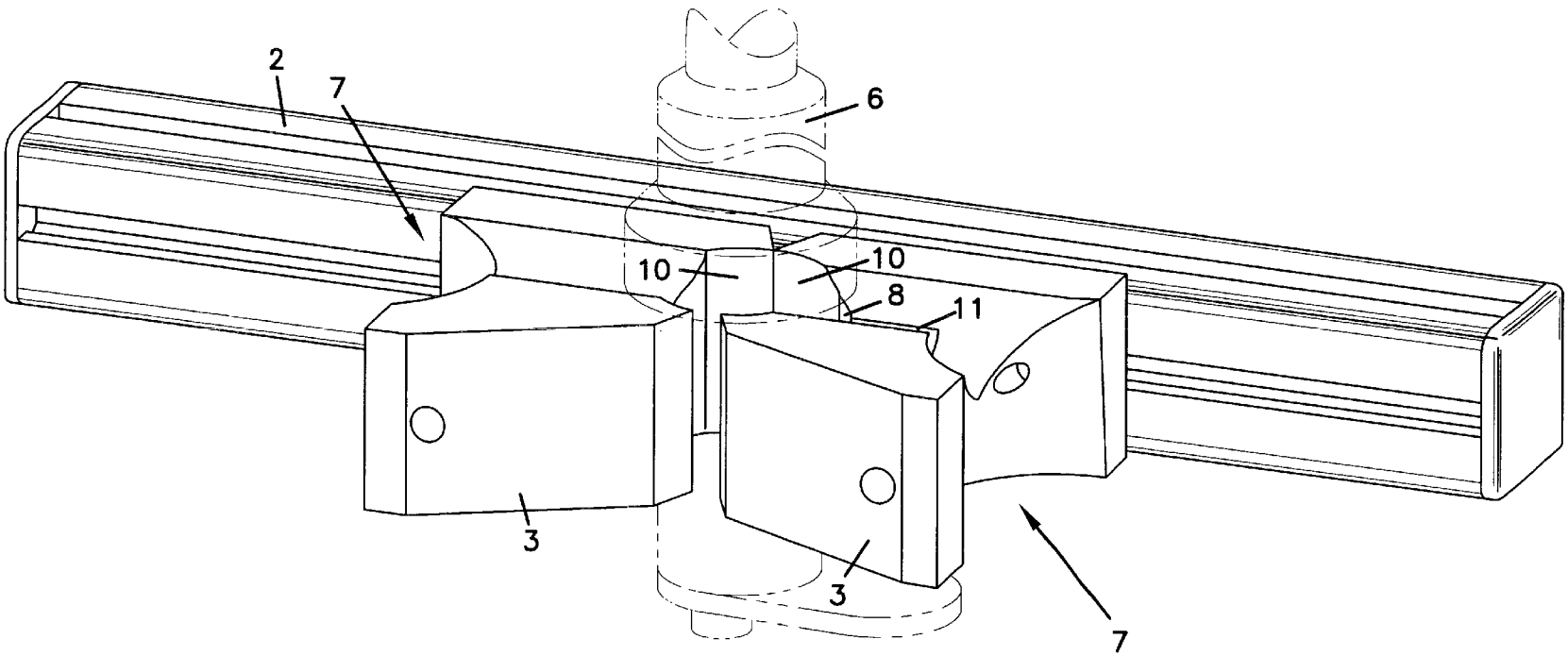
FIG. 4 is the holding device of FIGS. 1–3, with the retaining jaws rotated to another position.

FIG. 4 shows a further arrangement of the two retaining jaws 3. Here the retaining jaws are rotated 180° with respect to FIG. 1. The above-described recesses 10 form here no horizontal seat for placing a screwdriver or similar hand operated implement, but rather a holding quiver, into which—as is made clear by the schematically indicated pneumatic screwdriver 6—the implements can be inserted vertically.

Also, with this quiver arrangement of the two retaining jaws 3, the back side of the retaining jaws 3, larger with respect to the smaller front side of the retaining jaws 3, with which back side these rest on the carrier rail 2, has the effect that a free space remains on the front side of the two retaining jaws 3, so that the circular contour of the holding quiver for the implement is not completely closed. In this way a pneumatic or electrical cable for the implement can be guided through this free space when the implement is placed into the quiver or again removed from it. In particular, however, the distance between the two retaining jaws 3 is adjustable in such a manner that such a free space remains for a power line for the implement even when the two retaining jaws are arranged a short distance apart and the holding quiver formed through the recesses 10 surrounds the implement so narrowly that the latter is held securely in the holding device 1.

In the configuration with a small holding quiver, as shown in FIG. 4, the additional recess 11 likewise effects a free space for the actuating lever of the implement, so that an unnecessary running in idle of the implement can be reliably ruled out.

The holding device may include a securing device 32 for the implement. In this way it is not necessary to lock away the tools in cabinets at the end of the shift. For example, with the approximately 20,000 hand operated tools used in a single automobile factory, a daily time savings, representing a considerable economic value, is possible if the tools used can be secured right at the work location at shift end, for example in their holding device 1. For this purpose, provision can be made on the support rail 2 or on one or both retaining jaws 3 for a clamp, a chain, or something similar, by means of which the implement being held in the holding device 1 can be secured therein.

Such securing devices can, for example, be locked by padlocks and need not offer, on the whole, any great protection against break-ins, since, to the extent that it is recognizable that thefts are carried out only by personnel who have legitimate access to the premises, the typical theft takes place as a quick "walking off with" freely accessible objects. As soon as an increased time is required for stealing an object, this object is for practical purposes sufficiently secured.

Figure 5:
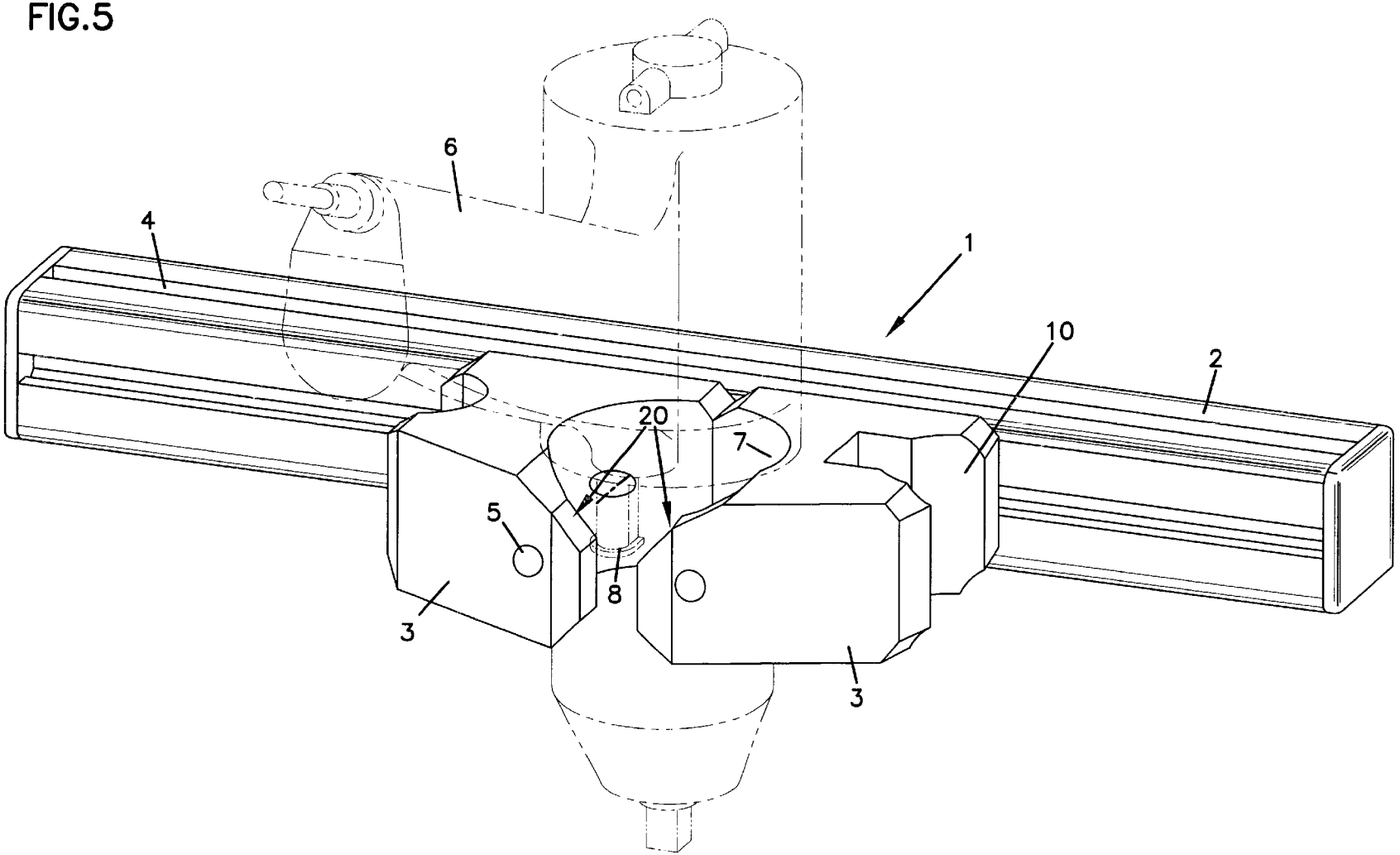
FIG. 5 is another implementation example of a holding device with differently arranged retaining jaws

In the holding device 1 according to FIG. 5, the pneumatic screwdriver 6 represented there can be inserted in a simple way and without requiring great attention, since it is inserted at an only approximately correct alignment between the retaining jaws 3. Oblique surfaces 20 in the process guide the actuating lever 8 into the gap that results on the front side of the holding device 1 between the two retaining jaws 3.

A protecting of the pneumatic screwdriver 6 also results in particular from the fact that the holding device 1 is cushioned. For this purpose the retaining jaws 3 consist of a solid plastic core 30 that lies within which core 30 is sprayed around with a softer plastic, for example a foam, and in this way displays a blow-dampening absorbent body, which determines the outer contours of the retaining jaws 3.

A wear-resistant, in particular non-abrasive, and at the same time blow-absorbing, pliable surface 31 of the retaining jaws 3 can be provided for through a separate coating that surrounds the absorbing body. Alternatively, provision can, for example, be made for the absorbing body to be formed from an integral skin foam, so that a high-value production process is made possible, in which the production of the absorbent body and the application of a closed surface is possible in a single operational step, in which the core of a holding jaw 3 is foamed around with the integral skin foam.

Figure 6:
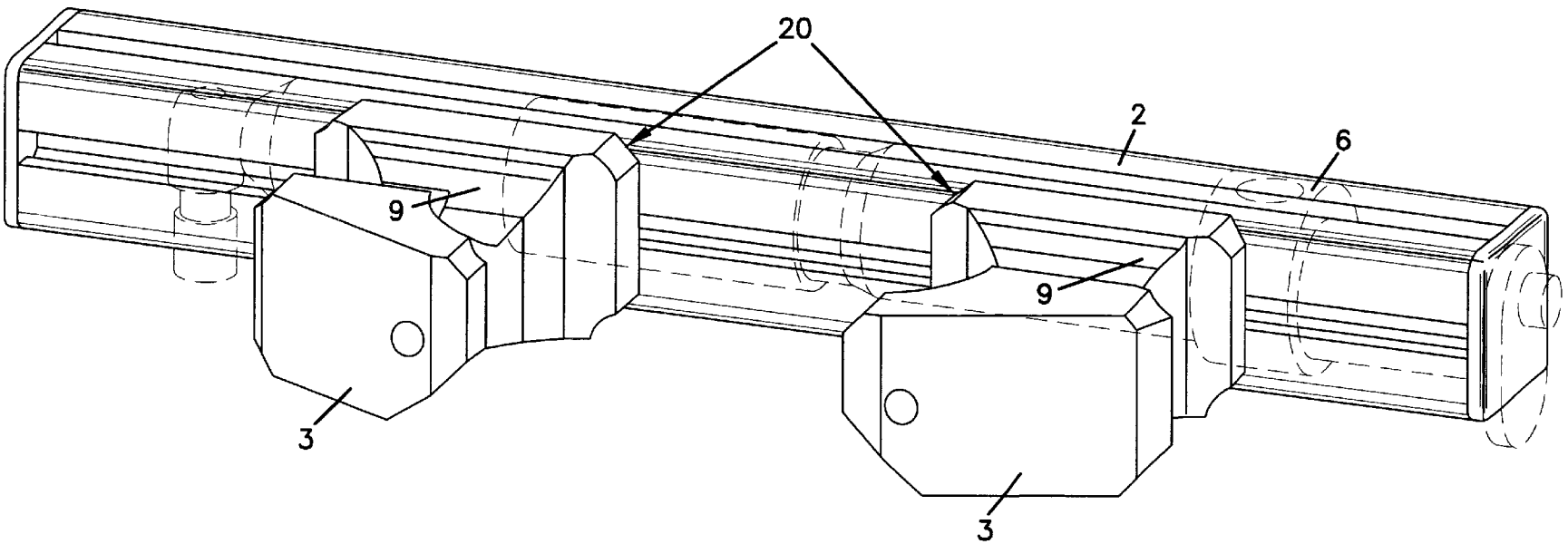
FIG. 6 is the holding device of FIG. 5, with the retaining jaws rotated to another position.

In FIG. 6, the retaining jaws 3 are represented, for one thing, spaced farther apart than in their arrangement in FIG. 5, and for another thing are also displaced and turned 180°. Here, recesses 9 result in a horizontal seat for placing a long, rod-shaped pneumatic screwdriver 6 that is provided with an angular head. An operating grip of the pneumatic screwdriver 6 is situated between the two retaining jaws 3, so that with this arrangement also an unnecessary running in idle of the implement is avoided.

In this representation it is also to be seen that pointed corners on the retaining jaws 3 are avoided and, instead of these, provision is made for oblique surfaces 20 or chamfers on the edges, so that, on the one hand, a material-sparing placement in the holding device for the implement possible, and on the other hand, a smooth course of movement is made possible, since the implement, when it is being placed into the device, cannot become hung up and caught on such a pointed corner.

Deviating from the design of foaming around a core with absorbent material, provision can be made for blow-absorbing zones in the retaining jaws 3 on a regional basis. This can take place through the gluing of absorbent cushions onto the retaining jaws or in the forms of padding that is set into the surfaces of the retaining jaws 3.

What is claimed is:

1. Holding device adapted for holding implements, comprising:

a support beam;

first and second retaining jaws moveably engaged with said support beam so as to be moveable along said support beam independently of one another; said first retaining jaw defining a first axis of rotation generally perpendicular to said support beam, said second retaining jaw defining a second axis of rotation generally perpendicular to said support beam, each of said retaining jaws defining at least two recesses therein; and fixing means adapted to selectively prevent movement and rotation of said retaining jaws; wherein said first retaining jaw is rotatable about said first axis and said second retaining jaw is rotatable about said second axis so as to selectively enable any of said at least two recesses in said first jaw to cooperate with any of said at least two recesses in said second jaw to define a quiver adapted to support an implement, whereby a plurality of said quivers may be individually defined.

2. Holding device according to claim 1, wherein said retaining jaws comprise impact-absorbent padding.

3. Holding device according to claim 2, wherein each of said retaining jaws comprises a solid core with said padding disposed thereon.

4. Holding device according to claim 3, wherein said padding substantially completely surrounds said core.

5. Holding device according to claim 1, wherein said support beam defines longitudinal grooves therein.

6. Holding device according to claim 5, further comprising blocks slidably disposed in at least one of said grooves, said retaining jaws being connected to said blocks.

7. Holding device according to claim 1, wherein at least some of said recesses are shaped such that at least one of said quivers is conically tapered.

8. Holding device according to claim 1, further comprising a lockable security device adapted for fixing the implement in said holding device.

9. Holding device according to claim 1, wherein said recesses comprise edges, and wherein said edges are rounded off.

10. Holding device according to claim 1, wherein said first and second retaining jaws are rotatable to and fixable in substantially any orientation about said first and second axes of rotation.

11. Holding device according to claim 1, wherein said retaining jaws are adapted to bear directly against said support beam.

12. Holding device according to claim 1, wherein said retaining jaws are of integral, one-piece construction.

13. Holding device according to claim 1, wherein in at least one of said recesses in at least one of said retaining jaws a lever recess is also defined, said lever recess being adapted to accept an actuating lever of the implement.

14. Holding device according to claim 1, wherein said jaw comprises chamfered edges proximate said recesses.

* * * * *